US005932526A

United States Patent [19]

Person Hei et al.

[11] Patent Number: 5,932,526

[45] Date of Patent: Aug. 3, 1999

[54] ALKALINE ETHER AMINE CONVEYOR LUBRICANT

[75] Inventors: Kimberly L. Person Hei, Oakdale; Michael E. Besse, Golden Valley; Christopher S. Sykes, New Brighton, all of Minn.

[73] Assignee: Ecolab, Inc., St. Paul, Minn.

[21] Appl. No.: 08/879,963

[22] Filed: Jun. 20, 1997

[51] Int. Cl.[6] ..... C10M 173/02; C10M 133/06

[52] U.S. Cl. ..... 508/559; 508/562

[58] Field of Search ..... 508/559, 562

[56] References Cited

U.S. PATENT DOCUMENTS

| | | | |
|---|---|---|---|
| Re. 30,885 | 3/1982 | Rieder | 508/508 |
| 2,758,086 | 8/1956 | Stuart et al. | 508/545 |
| 3,148,747 | 9/1964 | Batchelor | 184/15.1 |
| 3,170,539 | 2/1965 | Snay et al. | 184/15.1 |
| 3,336,225 | 8/1967 | Sayad et al. | 508/528 |
| 3,576,234 | 4/1971 | Batchelor | 184/15.1 |
| 3,583,914 | 6/1971 | Garvin et al. | 508/245 |
| 3,661,784 | 5/1972 | Bellos | 508/547 |
| 3,766,068 | 10/1973 | Tesdahl et al. | 508/404 |
| 3,860,521 | 1/1975 | Aepli et al. | 508/438 |
| 4,226,325 | 10/1980 | Vandas | 198/493 |
| 4,233,176 | 11/1980 | Conner, Sr. | 252/392 |
| 4,289,636 | 9/1981 | Davis et al. | 508/309 |
| 4,342,596 | 8/1982 | Conner, Sr. | 106/14.13 |
| 4,348,210 | 9/1982 | Sung | 252/77 |
| 4,419,253 | 12/1983 | Kennedy et al. | 508/506 |
| 4,511,482 | 4/1985 | Horodysky | 508/528 |
| 4,521,321 | 6/1985 | Anderson et al. | 508/405 |
| 4,552,569 | 11/1985 | Horodysky | 252/403 |
| 4,557,848 | 12/1985 | Sung et al. | 508/562 |
| 4,566,879 | 1/1986 | Horodysky | 252/402 |
| 4,581,039 | 4/1986 | Horodysky | 44/409 |
| 4,589,992 | 5/1986 | Phillips et al. | 252/75 |
| 4,604,220 | 8/1986 | Stanton | 508/179 |
| 4,613,343 | 9/1986 | Horodysky et al. | 44/419 |
| 4,626,367 | 12/1986 | Kuwamoto et al. | 508/156 |
| 4,719,084 | 1/1988 | Schmid et al. | 508/517 |
| 4,752,405 | 6/1988 | Kyle et al. | 508/404 |
| 4,789,493 | 12/1988 | Horodysky | 508/554 |
| 4,824,586 | 4/1989 | Johnson et al. | 508/487 |
| 4,828,735 | 5/1989 | Minagawa et al. | 508/507 |
| 4,828,737 | 5/1989 | Sandberg et al. | 508/499 |
| 4,839,067 | 6/1989 | Jansen | 508/527 |
| 4,849,119 | 7/1989 | Horodysky | 508/527 |
| 4,895,668 | 1/1990 | Singh et al. | 508/517 |
| 4,929,375 | 5/1990 | Rossio et al. | 508/415 |
| 5,062,978 | 11/1991 | Weber et al. | 508/500 |
| 5,073,280 | 12/1991 | Rossio et al. | 508/410 |
| 5,174,914 | 12/1992 | Gutzmann | 508/410 |
| 5,182,035 | 1/1993 | Schmidt et al. | 508/527 |
| 5,223,162 | 6/1993 | Rossio | 508/179 |
| 5,282,992 | 2/1994 | Reichgott | 508/559 |
| 5,441,654 | 8/1995 | Rossio | 508/527 |
| 5,510,045 | 4/1996 | Remus | 508/558 |
| 5,585,031 | 12/1996 | Nibert et al. | 508/562 |
| 5,723,418 | 3/1998 | Person Hei et al. | 508/511 |

FOREIGN PATENT DOCUMENTS

| | | |
|---|---|---|
| A-70188/91 | 8/1991 | Australia . |
| 0 044 458 A1 | 1/1982 | European Pat. Off. . |
| 0 233 774 A3 | 8/1987 | European Pat. Off. . |
| 0 310 363 A1 | 4/1989 | European Pat. Off. . |
| 0 372 628 A2 | 11/1989 | European Pat. Off. . |
| 0 384 282 A1 | 8/1990 | European Pat. Off. . |
| 0 445 525 A1 | 9/1991 | European Pat. Off. . |
| 0 533 552 A1 | 3/1993 | European Pat. Off. . |
| 1 644 913 | 1/1971 | Germany . |
| 60-135492 | 7/1985 | Japan . |
| 2-055794 | 2/1990 | Japan . |
| WO 90/10053 | 9/1990 | WIPO . |
| WO 94/12028 | 6/1994 | WIPO . |
| WO 94/17170 | 8/1994 | WIPO . |
| WO 95/14795 | 6/1995 | WIPO . |
| WO 95/26389 | 10/1995 | WIPO . |
| WO 97/45509 | 12/1997 | WIPO . |

OTHER PUBLICATIONS

"Specifications and Properties of DUOMEEN® Diamines and Diamine Salts DUOMAC® Diamine Acetate Salts", *Armak Chemical Bulletin 85–1* pp. 1–5 (1985).

S. Block, "Disinfection, Sterilization, and Preservation", Lea & Febiger, pp. 228, 248–249 (1991).

S. Budavari, et al., "The Merck Index", Merck & Co., Inc., p. 323 (1989).

B. Davis "Recent Developments in the Technology of Surfactants", *Critical Reports on Applied Chemistry,* vol. 30, pp. 65–73 (1990).

G. Denton, "Chlorhexidine", Ch. 16, pp. 274–275 (No date).

G. Variotin, "Inhibition and Distruction of the Microbiol. Cell", P.F. D'Arcy, pp. 636–639, 675 and 685 (No date).

"Abstracts of Dimer Acid Use–Patents and Journal References", *Technical Bulletin 412C,* Emery Industries, Inc., Sep., 1971, (16 pgs.).

"Ever Evolving Chemistry . . . Everlasting Quality . . . ", Tomah[3] Products, Inc. brochure, (10 pgs.) (No date).

"Ether Amines", Tomah[3] Products, Inc. brochure, Mar. 2, 1995 (7 pgs.).

Sokalan® DCS Technical Information, BASF, Apr. 1988 (4 pgs.).

*Primary Examiner*—Ellen M. McAvoy

*Attorney, Agent, or Firm*—Merchant, Gould, Smith, Edell, Welter & Schmidt, P.A.

[57] ABSTRACT

The invention is a lubricant concentrate and a lubricant use-solution as well as methods of use. The lubricant concentrate and lubricant use-solution each include one or more ether amine compounds, and a surfactant. Each of the ether amine compounds has a formula selected from the group consisting of $R_1$—O—$R_2$ $NH_2$, $R_1$—O—$R_2$—NH—$R_3$—$NH_2$, and mixtures thereof, wherein $R_1$ is a linear or branched, saturated or unsaturated $C_6$–$C_{18}$ alkyl, $R_2$ is a linear or branched $C_1$–$C_8$ alkylene, and $R_3$ is a linear or branched $C_1$–$C_8$ alkylene group. The compositions of the invention also include a surfactant to solubilize the amine compound, and optionally, a source of alkalinity and an antimicrobial agent, among other adjuvants.

50 Claims, No Drawings

ALKALINE ETHER AMINE CONVEYOR LUBRICANT

FIELD OF THE INVENTION

The invention relates generally to ether amine-based lubricants and methods of using the same. More specifically, the invention relates to ether amine-based lubricants having an alkaline pH and which have improved lubricity in the presence of acidic soils.

BACKGROUND OF THE INVENTION

Beverages and other comestibles are often processed and packaged on mechanized conveyor systems which are lubricated to reduce friction between the packaging and the load bearing surface of the conveyor. In the past, the lubricants commonly used on the load bearing surfaces of these conveyor systems typically contained fatty acid soaps as the active lubricating ingredient.

Moreover, at least in a bottling operation, it is highly desirable that a lubricant be efficacious in lubricating the tracks upon which the various types of containers are transported, i.e. cans, glass and PET articles. Fatty acid lubricants are efficacious in conjunction with any of these types of containers. Thus, these lubricants are "universal" lubricants in their application to various beverage containers.

These fatty acid lubricants have in the past provided excellent lubricity. However, fatty lubricants are also known to form insoluble precipitates in the presence of calcium and magnesium cations commonly found in hard water. Water softeners and chemical chelating agents such as EDTA must be used with lubricants based on fatty acids to prevent formation of such precipitates. Failure to implement such measures generally results in the formation of a precipitate which may plug the spray nozzles used for applying the lubricant to the conveyor.

Antimicrobial agents are particularly useful for conveyor systems which may transport food substances. Spillage of beverages and other comestibles on the conveyor often results in the growth of bacteria, yeast and mold and may create a slime or soil which, in turn, hampers conveyor performance and may also detract from product purity and appearance. Antimicrobial agents are particularly useful for reducing slime formation in conveyor systems which may transport food substances.

Fatty acid based lubricants have been formulated with effective antimicrobial agents, however, the tendency to react with water hardness ions compromises the overall performance of the lubricant. Alternatives to fatty acid lubricants have also been developed, but these compositions also have certain shortcomings.

For example, Jansen, U.S. Pat. No. 4,839,067 discloses a process for the maintenance of chain-type conveyor belts by treating the conveyor belt with an antimicrobial lubricant composition containing a lubricating amount of a neutralized $C_{12-18}$ primary fatty amine. However, as noted in Jansen, the primary fatty amines tend to form a precipitate in the presence of anions such as $SO_4^{-2}$, $PO_4^{-3}$ and $CO_3^{-2}$, commonly found as impurities in water. The precipitate may plug spray nozzles and soil the surfaces of the conveyor system in much the same way as fatty acid soaps in the presence of water hardness.

Schmidt et al., U.S. Pat. No. 5,182,035 discloses aliphatic ether diamines neutralized with acetic acid which are used in lubricant compositions in combination with alcoholic hydrotropes used to enhance physical stability.

Remus, U.S. Pat. No. 5,510,045, and counterpart WO 95/26389, discloses an amine lubricant composition for use with glass, aluminum and two-piece PET containers. The lubricant compositions comprise a mixture of amine, hydrotrope, and alkalinity source to maintain the pH above 8.

Weber et al., U.S. Pat. No. 5,062,978 also discloses aqueous lubricant compositions based upon neutralized fatty alkyl amines which are useful in conveyor belt operations, especially in the transport of bottles.

Schapira, Published European Patent Application No. 0,533,522 A1 discloses lubricant compositions comprising branched saturated or unsaturated $C_6$ to $C_{21}$ alkyl ether amines and diamines neutralized to provide water solubility and lubricity. The lubricant compositions are useful in conveyor operations and may also comprise a surfactant, and an alcohol solvent.

Even though fatty amines have been found to provide adequate lubricity and antimicrobial activity, their usefulness is limited because of the tendency to form precipitates in the presence of those anions commonly found in water.

Accordingly, a substantial need still exists for an antimicrobial conveyor lubricant which provides a tolerance for both anions and cations commonly found in the water used to dilute the lubricant formulation prior to application to the conveyor system, and superior lubricity in the presence of food spillage such as beer.

SUMMARY OF THE INVENTION

In accordance with a first aspect of the invention, there is provided a lubricant concentrate comprising an effective lubricating amount of one or more ether amine compounds. Each of the amine compounds has a formula selected from the group consisting of, $R_1$—O—$R_2$—$NH_2$, $R_1$—O—$R_2$—NH—$R_3$—$NH_2$, and mixtures thereof wherein $R_1$ is a linear or branched, saturated or unsaturated $C_6$–$C_{18}$ alkyl group, $R_2$ is a linear or branched $C_1$–$C_8$ alkylene group, and $R_3$ is a linear or branched $C_1$–$C_8$ alkylene group. The composition also comprises an amount of surfactant effective to solubilize the ether amine compound when diluted with water.

In accordance with a further aspect of the claimed invention, there is provided a lubricant use-solution comprising a major portion of water, and from about 10 ppm to 10000 ppm of one or more amine compounds. Each of the amine compounds has a formula selected from the group consisting of $R_1$—O—$R_2$—$NH_2$, $R_1$—O—$R_2$—NH—$R_3$—$NH_2$, and mixtures thereof wherein $R_1$ is a linear or branched, saturated or unsaturated $C_6$–$C_{18}$ alkyl, $R_2$ is a linear or branched $C_1$ $C_8$ alkylene, and $R_3$ is a linear or branched $C_1$–$C_8$ alkylene group. The lubricant use-solution also includes a surfactant used to solubilize the amine compound.

In accordance with another aspect of the claimed invention, there is provided a method of lubricating a conveyor system using a lubricant use-solution comprising one or more amine compounds each of which has a formula selected from the group consisting of, $R_1$—O—$R_2$—$NH_2$, $R_1$—O—$R_2$—NH—$R_3$—$NH_2$, and mixtures thereof wherein $R_1$ is a linear or branched, saturated or unsaturated $C_6$–$C_{18}$ alkyl, $R_2$ is a linear or branched $C_1$–$C_8$ alkylene, and $R_3$ is a linear or branched $C_1$–$C_8$ alkylene. The lubricant use-solution also includes a surfactant used to solubilize the amine compound, and a balance of water. The method comprises the step of applying the lubricant use-solution to the intended surface of use.

The invention is a lubricant concentrate and a lubricant use-solution each comprising linear or branched, saturated or unsaturated alkyl ether amines. The alkyl ether amine compounds promote lubricity in the aqueous lubricant use-solution despite the presence of ions and acidic beverage soils, such as acidic beer soils which often have a pH of 3 to 4 or less.

The invention provides reduced soiling of conveyors resulting from the diminished interaction of food soil with the lubricant use-solution. Compositions of the invention also provide greater lubricant use-solution tolerance to ion laden water. Further, the lubricant use-solution of the invention also has antimicrobial efficacy on non-food contact surfaces providing a reduction of bacterial colony forming units of 99.9% within five minutes.

In the context of this invention, the "lubricant concentrate" is that composition which is diluted prior to use. In turn, the "lubricant use-solution" is the lubricant composition which, once diluted, is applied to the intended surface.

DETAILED DESCRIPTION OF THE PREFERRED EMBODIMENT

The invention is a lubricant concentrate, a lubricant use-solution, and a method of using the lubricant use-solution. The lubricant concentrate may be a solid or liquid.

The lubricant concentrate and lubricant use-solution of the invention include linear and branched, saturated and unsaturated alkyl ether amine compounds which provide lubricity, antimicrobial character, as well as a reduction in the formation of various precipitates which often occur in the environment of use.

Compositions of the invention include surfactant solubilizers, and may also include antimicrobial agents, and sources of alkalinity, among other constituents. The invention also includes methods of using the claimed invention.

A. The Alkyl Ether Amine Compounds

The lubricant concentrate and lubricant use-solution of the invention comprise an amine compound. The amine compound provides compositional lubricity, furthers antimicrobial character, and reduces or eliminates the formation of various precipitates resulting from the dilution with water and/or contaminants on the surface of application.

The amine compounds of the invention may comprise any number of species. Preferably, the amine compound is an alkyl ether amine compound of the formula, $$R_1—O—R_2—NH_2, \quad (1)$$

$$R_1—O—R_2—NH—R_3—NH_2, \quad (2)$$

and mixtures thereof wherein $R_1$ may be a linear or branched, saturated or unsaturated $C_6$–$C_{18}$ alkyl, $R_2$ may be a linear or branched $C_{1-8}$ alkylene, and $R_3$ may be a linear or branched $C_1$–$C_8$ alkylene.

More preferably, $R_1$ is a linear or branched $C_{12}$–$C_{16}$ alkyl; $R_2$ is a $C_2$–$C_6$ linear or branched alkylene; and $R_3$ is a $C_2$–$C_6$ linear or branched alkylene.

Preferably, the lubricant concentrate and lubricant use-solution of the invention comprise one or more amine compounds having $R_1$ present as a linear $C_6$–$C_{18}$ alkyl. When $R_1$ is a linear alkyl group, the lubricant use-solution resulting from the lubricant concentrate provides enhanced lubricity.

More preferably the lubricant concentrate and lubricant use-solution of the invention have a pH of greater than 9, are free of any added acid source and have one or more amine compounds where $R_1$ is a linear $C_6$–$C_{18}$ alkyl group.

Preferred compositions of the invention include linear alkyl ether diamine compounds of formula (2) wherein $R_1$ is $C_{12}$–$C_{16}$ alkyl, $R_2$ is $C_3$ alkylene, and $R_3$ is $C_3$ alkylene.

When the amine compound used is an amine of formulas (1) and (2), $R_1$ may also be either a linear or branched alkyl $C_{12}$–$C_{16}$ or a mixture of linear alkyl $C_{10}$–$C_{12}$ and $C_{14}$–$C_{16}$.

Overall the linear or branched alkyl ether amine compounds used in the composition of the invention provide lower use concentrations, upon dilution, with enhanced lubricity. The amount of the amine compound in the lubricant concentrate generally ranges from about 0.1 wt % to 90 wt-%, preferably about 0.25 wt-% to 75 wt-%, and more preferably about 0.5 wt-% to 50 wt-%. These materials are commercially available from Tomah Products Incorporated as PA-19, PA-1618, PA-1816, DA-18, DA-19, DA-1618, DA-17, DA-1816, and the like.

More specifically, Tomah DA 1618 is $C_{12-14}$ linear alkyloxypropyl-1,3-diaminopropane; Tomah DA-18 is $C_{14}$ linear alkyloxypropyl-1,3-diaminopropane; Tomah DA-17 is a branched N-isotridecyloxypropyl-1,3-diaminopropane; and Tomah PA-19 is linear alkyloxypropylamine.

Representative alkyl ether amine compounds are generally formulated from linear or branched $C_{12}$ or greater alkyl alcohols and acrylonitrile to provide an ether amine according to the scheme provided below:

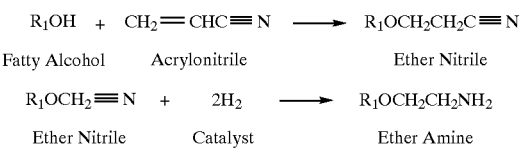

wherein $R_1$ is defined as above. Diamines may be synthesized according to the following scheme:

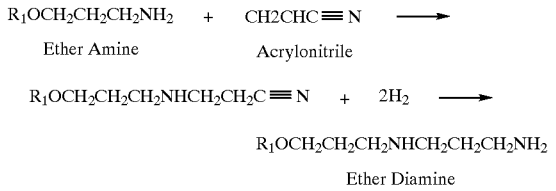

wherein $R_1$ is defined as above.

The dilution of the lubricant concentrate with water results in a lubricant use-solution which is preferably calculated to provide lubricity in the intended application or use. Accordingly, the active amine compound concentration in the lubricant use-solution of the invention ranges from about 10 ppm to 10000 ppm, preferably from about 30 ppm to 5000 ppm, and more preferably about 50 ppm to 2000 ppm.

B. Surfactants

The lubricant concentrate and lubricant use-solution of the invention also comprises a surfactant. The surfactant functions as an hydrotrope to solubilize the ether amine in the aqueous lubricant concentrate and use-solution and increases phase stability. The surfactant also increases detergency in the lubricant use-solution. Compounds which may be used as surfactants in the invention include nonionic surfactants, among other compounds.

Nonionic surfactants are generally hydrophobic compounds which bear essentially no charge and exhibit a hydrophilic tendency due to the presence of oxygen in the molecule. Nonionic surfactants encompass a wide variety of polymeric compounds which include specifically, but not exclusively, alkoxylated alkylphenols, alkoxylated aliphatic alcohols, alkoxylated amines, alkoxylated ether amines, carboxylic esters, carboxylic amides, and polyoxyalkylene oxide block copolymers. Preferably, the alkoxy group is a ethoxy or propoxy group, and most preferably ethoxy.

Particularly suitable nonionic surfactants for use in the lubricant concentrate and lubricant use-solution of the invention are the alkoxylated (preferably ethoxylated) alcohols having the general formula $R_1((CH_2)_mO)_n$ wherein $R_1$ is an aliphatic group having from about 8 to about 24 carbon atoms, m is a whole number from 1 to about 5, and n is a number from 1 to about 40 which represents the average number of ethylene oxide groups on the molecule.

Nonionic surfactants which have been found useful in the invention include nonylphenol ethoxylates with about 9.5 moles of ethoxylation available from Stepan Chemical Co. as Macon 9 and $C_{12-15}$ linear alcohol ethoxylates having about 9 moles of ethoxylation available from Shell Chemical Company as Neodol 25-9. Also useful are the ethoxylated ether amines synthesized by the following reaction sequence:

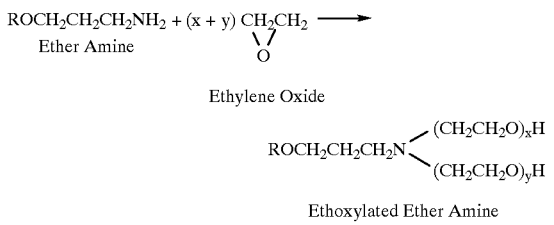

Generally, in the lubricant concentrate, the surfactant concentration ranges from about 0.1 wt-% to 66 wt-%, and preferably from about 0.5 wt-% to 50 wt-%. More preferably the surfactant concentration ranges from about 1 to 30 wt-%.

C. The Alkalinity Source

Generally, the lubricant concentrate and lubricant use-solution of the invention have an alkaline pH. The lubricant concentrate of the invention has a pH which is about 10 or greater and preferably ranges from about 10 to 13. In turn, the lubricant use-solution generally has a pH of greater than about 9.0, preferably about 9.5 to 13 without any added source of alkalinity other than the surfactant and amine compound. However, if other adjuvants are added to the lubricant concentrate or lubricant use-solution of the invention which lower the lubricant concentrate and lubricant use-solution pH, alkalinity sources may be added.

The general character of the alkalinity sources is limited only to those chemical compositions which have solubility in the system. That is, the alkalinity source should not contribute metal ions which promote the formation of precipitates or film salts. Exemplary alkalinity sources include silicates, hydroxides, phosphates, carbonates, and alkanolamines.

When present, the alkalinity source may be used to raise compositional pH to the desired level. As a result, the concentration of the alkalinity source may vary considerably given the type of alkalinity source and the required pH increase.

D. Antimicrobial Agents

Generally, the lubricant concentrate and lubricant use-solution have antimicrobial efficacy providing a 99.9% reduction of colony forming units of bacteria within five minutes of contact. However, if added antimicrobial efficacy is desired, the lubricant concentrate and lubricant use-solution of the invention may also comprise one or more antimicrobial agents. Generally, any solid or liquid chemical agent having microbicidal efficacy may be used in the invention. Chemical compositions known to impart microbicidal efficacy at pH 9 or greater include iodophors, phenolics, and quaternary ammonium compounds.

Preferred antimicrobials useful in the invention are cationic surfactants such as alkyl and benzyl quaternary compounds like N-alkyl ($C_{12-18}$) dimethylbenzyl ammonium chloride, N-alkyl ($C_{14-18}$) dimethylbenzyl ammonium chloride, N-tetradecylidmethylbenzyl ammonium chloride monohydrate, dimethyl didecyl ammonium chloride, and N-alkyl and($C_{12-14}$) dimethyl 1-napthylmethyl ammonium chloride which are available commercially from manufacturers such as Stepan Chemical Company.

When present, an antimicrobial agent must have a concentration effectively necessary for the required action to be provided. Generally, in the lubricant concentrate the concentration of antimicrobial agent may range from about 0.1 to 10 wt-%, preferably from about 1 to 8 wt-%, and most preferably from about 2 to 6 wt-%.

E. ADJUVANTS

The lubricant concentrate and, in turn, lubricant use-solution of the invention may also comprise one or more adjuvants to modify the character or properties of those compositions. Representative adjuvants include viscosity modifiers, soil anti-redeposition agents, preservatives, dyes, fragrances, anti-foaming agents, soil suspension and solubilizing agents, as well as penetrants, among others.

FORMULATION

The lubricant use-solution of the invention may be formulated as a lubricant concentrate which is later diluted to the lubricant use-solution for use in a given application. Generally, the lubricant concentrate may be diluted from about 10 to 10,000 times to provide the lubricant use-solution depending upon amine compound concentration. The following Table includes guidelines for various concentrations for the composition of the invention.

TABLE 1

| | useful | preferred | more preferred |
|---|---|---|---|
| | -Lubricant Concentrate- (wt-%) | | |
| Amine | 0.1–90 | 0.25–75 | 0.5–50 |
| Surfactant | 0.1–66 | 0.5–50 | 1–30 |
| pH | 10 or greater | 10–13 | 11–13 |
| Water | Q.S. | Q.S. | Q.S. |

TABLE 1-continued

| | useful | preferred | more preferred |
|---|---|---|---|
| | -Lubricant Use-solution- (PPM) | | |
| Amine (ppm) | 10–10,000 | 30–5000 | 50–2000 |
| pH | greater than 9 | 9.5–13 | 10–13 |
| Surfactant | 10–5000 | 25–3000 | 100–2500 |

WORKING EXAMPLES

The following Working Examples illustrate various properties, characteristics and exemplary embodiments of the invention. However, these examples are not intended to be construed as limiting of the claimed invention.

Working Example 1

Preparation of Non-Neutralized Compositions and Neutralized Controls

Compositions 1–7 were prepared by adding the ether amine and ethoxylated surfactant to water with stirring. The ether amines in Composition 3 were not adequately solubilized by the surfactants, as evidenced by phase separation. This Composition was prepared again with a higher surfactant to amine ratio as Composition 7. No phase separation occurred with this composition.

For Compositions 1, 2, and 4–7 the pH was in excess of 11, indicating that the amines are not in a neutralized state. Typically, unneutralized, saturated alkyl amines having an alkyl group of greater than 10 carbons are water insoluble. Water solubility with these Compositions was achieved through coupling by the surfactants.

Compositions 8 and 9 represent Comparative Examples which have been neutralized with acetic acid. In Compositions 8 and 9, the ether amines were solubilized with acetic acid neutralization, and the surfactant was included for detergency properties. The compositional pH for Compositions 8 and 9 was a pH of 7.0–7.5.

| | Compositions (wt-%) | | | | |
|---|---|---|---|---|---|
| Raw Materials | 1 | 2 | 3 | 4 | 5 |
| $C_{12-14}$ Linear Alkyl Ether Diamine | 5 | | | 5 | 5 |
| $C_{14}$ Linear Alkyl Ether Diamine | | 5 | | | |
| $C_{11-14}$ Branched Alkyl Ether Diamine | | | 5 | | |
| $C_{12-15}$ Linear Alkyl Amine | | | | | |
| $C_{12-15}$ Ethoxylated Linear Alkyl Ether Amine, 7 EO | 10 | 10 | 10 | | |
| $C_{12-15}$ Ethoxylated Linear Alkyl Amine, 15 EO | | | | 10 | |
| Ethoxylated Nonylphenol, 9.5 EO | | | | | 10 |
| $C_{12-15}$ Ethoxylated Linear Alcohol, 9 EO | | | | | |
| Acetic Acid, glacial | | | | | |
| Soft Water | 85 | 85 | 85 | 85 | 85 |
| Total (wt-%) | 100 | 100 | 100 | 100 | 100 |
| composition pH | 11.6 | 11.5 | — | 11.5 | 11.2 |
| 0.5% Solution pH (DI water) | 10.2 | 10.1 | — | 10.2 | 10.0 |

-continued

| | Compositions (wt-%) | | | | |
|---|---|---|---|---|---|
| Raw Materials | 6C | 7 | 8 | 9 | 10C |
| $C_{12-14}$ Linear Alkyl Ether Diamine | 5 | | 5 | 3 | 5 |
| $C_{14}$ Linear Alkyl Ether Diamine | | | | | |
| $C_{11-14}$ Branched Alkyl Ether Diamine | | 3 | | | |
| $C_{12-15}$ Linear Alkyl Amine | | | | | |
| $C_{12-15}$ Ethoxylated Linear Alkyl Ether Amine, 7 EO | | 20 | 10 | 10 | |
| $C_{12-15}$ Ethoxylated Linear Alkyl Amine, 15 EO | | | | | |
| Ethoxylated Nonylphenol, 9.5 EO | | | | | |
| $C_{12-15}$ Ethoxylated Linear Alcohol, 9 EO | 10 | | | | |
| Acetic Acid, glacial | | | 1.6 | 1.5 | 1.5 |
| Soft Water | 85 | 77 | 83.4 | 85.5 | 93.5 |
| Total (wt-%) | 100 | 100 | 100 | 100 | 100 |
| Composition pH | 11.2 | 11.4 | 7.5 | 7.0 | 6.1 |
| 0.5% Solution pH (DI water) | 10.1 | 10.2 | 7.7 | 7.1 | |
| 1.0% Solution pH | 10.2 | | | | 6.9 |

This work illustrates that alkyl ether amines can be solubilized into aqueous compositions using various surfactants including ethoxylated nonionic surfactants.

Working Example 2

LUBRICITY

Lubricant Use-solutions 6D and 10D ("D" indicating dilute) were prepared from Lubricant Concentrates 6C and 10C ("C" indicating concentrate) (as prepared in Working Example 1), respectively, by dilution with city water to 0.5 wt-%.

Measurement of Gliding Action

Lubricant Use-solutions 6D and 10D were streamed along the perimeter of a polished stainless steel plate measuring 20.5 cm in diameter. The plate was connected to an electric motor, and rotated at an even rate when switched on. A glass disk weighing 189 gm was attached to a load cell and placed on the plate in the area wetted by Lubricant Use-solutions 6D and 10D. When the electric motor was switched on, the disk glided freely on the plate. The drag between the glass disk and the stainless steel plate was detected by the load cell, and transferred to a chart recorder.

To assure consistency of the test method, the drag from a standard fatty acid Lubricant Use-solution was measured before and after trial runs, and the value obtained therefrom arbitrarily assigned a coefficient of friction of 1.00. Each trial run was referenced to the fatty acid Lubricant Use-solution trials, thus the results are reported as a relative coefficient of friction (COF). The lower the COF, the better the lubricity.

The formulation used as a control was a fatty acid lubricant concentrate comprising:

| Raw Material (wt-%) | Control |
|---|---|
| Soft Water | 54.70 |
| Hexalene Glycol | 2.00 |

-continued

| Raw Material (wt-%) | Control |
|---|---|
| Sodium Xylene Sulfonate | 1.60 |
| Tetrasodium EDTA liquid | 10.20 |
| TEA, 85% | 13.50 |
| Nonionic Surfactant | 8.00 |
| Fatty Acid | 10.00 |
| | 100.00 |

and the COF for this composition was:

| Formula[1] | Relative Coefficient of Friction |
|---|---|
| Fatty Acid Control | Glass on Stainless |
| Lubricant Use-Solution | 1.00 |

[1]Formula was tested at 0.1% wt in distilled water containing 200 ppm added $NaHCO_3$.

| Lubricant Use-solution 6D | | Alkaline | |
|---|---|---|---|
| Parts Beer | Parts Lubricant Use Solution* | pH | Relative COF Glass on Stainless |
| 0 | 100 | 9.62 | 0.85 |
| 1 | 100 | 8.72 | 0.79 |
| 2 | 100 | 7.34 | 0.80 |
| 4 | 100 | 6.98 | 0.81 |
| 8.34 | 100 | 6.48 | 0.82 |
| 15.7 | 100 | 5.71 | 0.89 |
| 33.3 | 100 | 5.38 | 0.94 |

| Lubricant Use-solution 10D | | Neutralized | |
|---|---|---|---|
| Parts Beer | Parts Lubricant Use Solution* | pH | Relative COF Glass on Stainless |
| 0 | 100 | 7.52 | 0.94 |
| 1 | 100 | 6.69 | 0.94 |
| 2 | 100 | 6.43 | 0.96 |
| 4 | 100 | 6.28 | 1.00 |
| 8.34 | 100 | 5.84 | 1.01 |
| 15.7 | 100 | 5.44 | 1.05 |
| 33.3 | 100 | 5.16 | 1.08 |

*(0.50% in city water)

Lubricant Use-solution 6D demonstrated superior lubricity in the absence and the presence of acidic soil. This may result from the neutral to alkaline pH afforded by solubilization rather than neutralization of the amine species in the lubricant concentrate.

The above specification, examples and data provide a complete description of the manufacture and use of the composition of the invention. Since many embodiments of the invention can be made without departing from the spirit and scope of the invention, the invention resides in the claims hereinafter appended.

The claimed invention is:

1. A lubricant concentrate comprising:

(a) an effective lubricating amount of one or more ether amine compounds each of said amine compounds having a formula selected from the group consisting of,
$R_1$—O—$R_2$—$NH_2$,
$R_1$—O—$R_2$—NH—$R_3$—$NH_2$,
and mixtures thereof wherein $R_1$ is a linear, saturated or unsaturated $C_6$–$C_{18}$ alkyl group, $R_2$ is a linear or branched $C_1$–$C_8$ alkylene group, and $R_3$ is a linear or branched $C_1$–$C_8$ alkylene group; and (b) an amount of surfactant effective to solubilize said ether amine compound when diluted with water wherein said lubricant concentrate composition has a pH of above about 10.

2. The lubricant concentrate of claim 1, wherein said ether amine compound is present in a concentration of about 0.25 wt-% to 75 wt-%.

3. The lubricant concentrate of claim 1, wherein said ether amine compound is present in a concentration of about 0.5 to 50 wt-%.

4. The lubricant concentrate of claim 1, wherein said amine compound is a monoamine compound, $R_1$ is a linear $C_{12}$–$C_{16}$ alkyl group, and $R_2$ is a $C_2$–$C_6$ alkylene group.

5. The lubricant concentrate of claim 1, wherein more than one ether amine compound is present in said lubricant concentrate, at least one of said ether amine compounds is a monoamine compound, $R_1$ is selected from the group consisting of a linear $C_{10}$–$C_{12}$ alkyl group, a linear $C_{14}$–$C_{16}$ alkyl group, and mixtures thereof, and $R_2$ is a $C_2$–$C_6$ alkylene group.

6. The lubricant concentrate of claim 1, wherein said ether amine compound is a diamine compound, $R_1$ is a linear $C_{12}$–$C_{16}$ alkyl group, $R_2$ is a $C_2$–$C_6$ alkylene group, and $R_3$ is a $C_2$–$C_6$ alkylene group.

7. The lubricant concentrate of claim 1, wherein more than one ether amine compounds is present in said lubricant concentrate, at least one of said ether amine compounds is a diamine compound, $R_1$ is selected from the group consisting of a linear $C_{10}$–$C_{12}$ alkyl group, a linear $C_{14}$–$C_{16}$ alkyl group, and mixtures thereof, $R_2$ is a $C_2$–$C_6$ alkylene group, and $R_3$ is a $C_2$–$C_6$ alkylene.

8. The lubricant concentrate of claim 1, wherein said surfactant comprises a nonionic surfactant selected from the group consisting of an alkyl phenol ethoxylate, a linear alcohol ethoxylate, a secondary alcohol ethoxylate, an ethoxylated linear alkyl amine, an ethoxylated linear alkyl ether amine, and mixtures thereof.

9. The lubricant concentrate of claim 1, wherein said surfactant comprises an alkoxylated nonionic surfactant which is present in a concentration of from about 0.5 wt-% to 50 wt-%.

10. The lubricant concentrate of claim 1, wherein said surfactant comprises an alkoxylated nonionic surfactant which is present in a concentration of from about 1 to 30 wt-%.

11. The lubricant concentrate of claim 9, wherein said nonionic surfactant has from about 1 to 40 moles of ethoxylation.

12. A lubricant use-solution resulting from aqueous dilution of the lubricant concentrate of claim 1, wherein said amine compound is present in said lubricant use-solution in a concentration ranging from about 50 ppm to 2000 ppm.

13. The lubricant concentrate of claim 1, wherein said amine compound comprises a tetradecyl oxypropyl-1, 3-diamino propane.

14. The lubricant concentrate of claim 1, wherein said lubricant concentrate is a solid.

15. The lubricant concentrate of claim 1, wherein said lubricant concentrate is a liquid.

16. The lubricant concentrate of claim 1, wherein said lubricant concentrate additionally comprises a source of alkalinity.

17. The lubricant concentrate of claim 16, wherein said source of alkalinity is present in an amount necessary to provide a pH greater than about 9 up to about 13 upon dilution of said lubricant concentrate with water.

18. The lubricant concentrate of claim 1, wherein $R_1$ is a linear $C_6$–$C_{18}$ alkyl and the pH of the lubricant concentrate ranges from about 10 to 13.

19. The lubricant concentrate of claim 1, further comprising an antimicrobial agent.

20. The lubricant concentrate of claim 19, wherein said antimicrobial agent comprises a quaternary ammonium compound.

21. A lubricant use-solution comprising a major portion of water, from about 10 ppm to 10,000 ppm of one or more ether amine compounds, each of said amine compounds having a formula selected from the group consisting of $R_1$—O—$R_2$—$NH_2$, $R_1$—O $R_2$—NH—$R_3$—$NH_2$, and mixtures thereof wherein $R_1$ is a linear, saturated or unsaturated $C_6$–$C_{18}$ alkyl, $R_2$ is a linear or branched $C_1$–$C_8$ alkylene, and $R_3$ is a linear or branched $C_1$–$C_8$ alkylene group; and an amount of surfactant effective to solubilize said amine compound wherein said lubricant use-solution has a pH of greater than about 9.

22. The lubricant use-solution of claim 21, wherein said amine compound is present in a concentration of about 30 to 5000 ppm.

23. The lubricant use-solution of claim 21, wherein said ether amine compound is a monoamine compound, $R_1$ is a linear $C_{12}$–$C_{16}$ alkyl group, and $R_2$ is a $C_2$–$C_6$ alkylene group.

24. The lubricant use-solution of claim 21, wherein more than one ether amine compound is present in said lubricant use-solution, at least one of said ether amine compounds is a monoamine compound, $R_1$ is selected from the group consisting of a linear $C_{10}$–$C_{12}$ alkyl group, a linear $C_{14}$–$C_{16}$ alkyl group, and mixtures thereof, and $R_2$ is a $C_2$–$C_6$ alkylene group.

25. The lubricant use-solution of claim 21, wherein said ether amine compound is a diamine compound, $R_1$ is a linear $C_{12}$–$C_{16}$ alkyl group, $R_2$ is a $C_2$–$C_6$ alkylene group, and $R_3$ is a $C_2$–$C_6$ alkylene group.

26. The lubricant use-solution of claim 21, wherein more than one ether amine compounds is present in said lubricant use-solution, at least one of said ether amine compounds is a diamine compound, $R_1$ is selected from the group consisting of a linear $C_{10}$–$C_{12}$ alkyl group, a linear $C_{14}$–$C_{16}$ alkyl group, and mixtures thereof, $R_2$ is a $C_2$–$C_6$ alkylene group, and $R_3$ is a $C_2$–$C_6$ alkylene group.

27. The lubricant use-solution of claim 21, wherein said surfactant comprises a nonionic surfactant selected from the group consisting of an alkyl phenol ethoxylate, a linear alcohol ethoxylate, a secondary alcohol ethoxylate, an ethoxylated linear alkyl amine, an ethoxylated linear alkyl ether amine, and mixtures thereof.

28. The lubricant use-solution of claim 21, wherein said surfactant comprises an alkoxylated nonionic which is present in a concentration of from about 25 ppm to 3000 ppm.

29. The lubricant use-solution of claim 21, wherein said surfactant comprises an alkoxylated nonionic which is present in a concentration of from about 100 ppm to 2500 ppm.

30. The lubricant use-solution of claim 28, wherein said surfactant comprises a nonionic surfactant having from about 1 to 40 moles of ethoxylation.

31. The lubricant use-solution of claim 21, wherein said lubricant use-solution has antimicrobial efficacy.

32. The lubricant use-solution of claim 21, wherein $R_1$ is a linear $C_6$–$C_{18}$ alkyl and the pH of the lubricant use-solution ranges from about 9 to 13.

33. A method of lubricating a conveyor system comprising the steps of (a) diluting a lubricant concentrate with water to form an aqueous lubricant use-solution comprising an effective lubricating amount of one or more ether amino compounds, wherein each of said amine compounds in said lubricant concentrate has a formula selected from the group consisting of, $R_1$—O—$R_2$—$NH_2$, $R_1$—O—$R_2$—NH—$R_3$—$NH_2$, and mixtures thereof wherein $R_1$ is a linear saturated or unsaturated $C_6$–$C_{18}$ alkyl, $R_2$ is a linear or branched $C_1$–$C_8$ alkylene, and $R_3$ is a linear or branched $C_1$–$C_8$ alkylene, said lubricant concentrate further comprising an amount of surfactant effective to solubilize the amine in said lubricant concentrate upon dilution and use; and (b) applying said lubricant use-solution composition to the intended surface of use.

34. The method of claim 33, wherein said ether amine compound is a monoamine compound, $R_1$ is a linear $C_{12}$–$C_{16}$ alkyl group, and $R_2$ is a $C_2$–$C_6$ alkylene group.

35. The method of claim 33, wherein more than one ether amine compound is present in said lubricant use-solution, at least one of said ether amine compounds is a monoamine compound, $R_1$ is selected from the group consisting of a linear $C_{10}$–$C_{12}$ alkyl group, a linear $C_{14}$–$C_{16}$ alkyl group, and mixtures thereof, and $R_2$ is a $C_2$–$C_6$ alkylene group.

36. The method of claim 33, wherein said ether amine compound is a diamine compound, $R_1$ is a linear $C_{12}$–$C_{16}$ alkyl group, $R_2$ is a $C_2$–$C_6$ alkylene group, and $R_3$ is a $C_2$–$C_6$ alkylene group.

37. The method of claim 33, wherein more than one ether amine compound is present in said lubricant use-solution, at least one of said ether amine compounds is a diamine compound, $R_1$ is selected from the group consisting of a linear $C_{10}$–$C_{12}$ alkyl group, a linear $C_{14}$–$C_{16}$ alkyl group, and mixtures thereof, $R_2$ is a $C_2$–$C_6$ alkylene group, and $R_3$ is a $C_2$–$C_6$ alkylene group.

38. The method of claim 33, wherein said surfactant comprises a nonionic surfactant selected from the group consisting of an alkyl phenol ethoxylate, a linear alcohol ethoxylate, a secondary alcohol ethoxylate, an ethoxylated linear alkyl amine, an ethoxylated alkyl ether amine, and mixtures thereof.

39. The method of claim 33, wherein said surfactant comprises a nonionic surfactant which has from about 1 to 40 moles of ethoxylation.

40. The method of claim 33, wherein said ether amine compound comprises a tetradecyl oxypropyl-1, 3-diamino propane, said composition additionally comprising a nonionic surfactant.

41. The method of claim 33, wherein said amine compound is present in said lubricant use-solution at a concentration of about 30 to 5000 ppm.

42. The method of claim 33, wherein said amine compound is present in said lubricant use-solution at a concentration of about 50 ppm to 2000 ppm.

43. The method of claim 33, wherein said surfactant comprises an alkoxylated surfactant which is present in said lubricant use-solution at a concentration of about 25 to 3000 ppm.

44. The method of claim 33, wherein said surfactant comprises an alkoxylated surfactant which is present in said lubricant use-solution at a concentration of about 100 to 2500 ppm.

45. The method of claim 33, wherein said lubricant use-solution has antimicrobial efficacy on the intended surface of use.

46. The method of claim 45, wherein said lubricant use-solution further comprises an antimicrobial agent.

47. The method of claim 46, wherein said antimicrobial agent comprises a quaternary ammonium compound.

48. The method of claim 33, wherein said lubricant use-solution additionally comprises a source of alkalinity.

49. The method of claim 48, wherein said source of alkalinity is present in an amount necessary to provide a pH greater than about 9 up to 13.

50. The method of claim 33, wherein $R_1$ is a linear $C_6$–$C_{18}$ alkyl and the pH of the lubricant use-solution ranges from about 9 to 13.

* * * * *